US005275467A

United States Patent [19]

Kawecki

[11] Patent Number: 5,275,467

[45] Date of Patent: Jan. 4, 1994

[54] KNOCKDOWN CHAIR

[76] Inventor: David J. Kawecki, 1304 Haight St., San Francisco, Calif. 94117

[21] Appl. No.: 883,218

[22] Filed: May 14, 1992

[51] Int. Cl.[5] ..... A47C 7/00

[52] U.S. Cl. ..... 297/440.13; 297/411.4; 297/411.29

[58] Field of Search ..... 297/440, 442, 411, 416, 297/418; 29/897.3, 469, 525, 525.1

[56] References Cited

U.S. PATENT DOCUMENTS

| | | | |
|---|---|---|---|
| 2,615,505 | 10/1952 | Friedlander | 297/442 |
| 2,784,774 | 3/1957 | Andreef | 297/442 |
| 3,087,758 | 4/1963 | Deaton | 297/440 X |
| 3,466,092 | 9/1969 | Virany | 297/418 X |
| 3,485,527 | 12/1969 | Barghout | 297/442 |
| 3,909,064 | 9/1975 | Payne et al. | 297/258 X |
| 4,712,837 | 12/1987 | Swilley | 297/442 |
| 4,919,485 | 4/1990 | Guichon | 297/440 X |
| 5,011,228 | 4/1991 | Marcantel | 297/442 |
| 5,082,329 | 1/1992 | Mars | 297/418 X |
| 5,088,180 | 2/1992 | Nottingham et al. | 297/440 X |

*Primary Examiner*—Peter M. Cuomo

*Assistant Examiner*—Suzanne L. Dino

*Attorney, Agent, or Firm*—Douglas E. White

[57] ABSTRACT

A knockdown chair kit may be assembled by the end user without glue, nails, rivets or other fasteners and is strong and durable enough to to support an adult human in regular use. The kit is fabricated by means of laser cutting. The chair is made out of plywood, solid wood, wood composite, plastic, metal or other similar thin, flat stock. It uses a series of hooks, which hooks fit into slots having matched positions, in order to rigidly interlock the component members of the chair together and prevent them from pulling apart. A series of pegs are flush-mount, i.e. their height equals the thickness of the planar stock, so as not to project outwardly therefrom. A feature of the knockdown furniture kit is the use of a pair of hooks to grasp matched slots in the two ends of a U-shaped arm rest. The pair of hooks anchor the arm rest horizontally so as to present a flat surface for the user's arms to rest upon. At the same time, the arm rest itself remains in a stressed curved position, which position locks all previously assembled pieces together into one rigid whole.

6 Claims, 5 Drawing Sheets

KNOCKDOWN CHAIR

FIELD OF THE INVENTION

This invention relates to furniture designed for home assembly and disassembly, more particularly to a knockdown chair composed of interlocking flexible planar members.

BACKGROUND OF THE INVENTION

It is known to use interlocking tabs and slots to make children's toys out of cardboard and other planar stock. Until now, it has been impractical to make full-sized functioning furniture utilizing such tabs and slots, due to difficulty in cutting flat stock with the precision necessary to produce a joint that is capable of supporting significant weight during prolonged periods of use. With the advent of precision laser cutting methods, such furniture is now possible, utilizing the teachings of the present invention. This invention is believed to represent the first knockdown (i.e. self-assembled) piece of furniture which takes advantage of the benefits of the laser cutting process.

Prior developments in this field may be generally illustrated by reference to the following information disclosure statement:

| Pat. No. | Patentee | Issue Date |
|---|---|---|
| 5,000,514 | M. Hanson | Mar. 19, 1991 |
| 4,509,794 | B. Roland | Apr. 09, 1991 |
| 2,518,955 | A. Stelzer | Aug. 15, 1950 |
| 2,632,498 | P. Curtis | Mar. 24, 1953 |
| 2,486,987 | G. Scarlett | Nov. 01, 1949 |
| 4,593,950 | V. Infanti | Jun. 10, 1986 |
| 1,508,697 | L. Junker | Sep. 16, 1924 |
| 1,419,647 | W. Shepherdson | Jun. 13, 1922 |

U.S. Pat. Nos. 1,419,647, 5,000,514, 4,509,794 and 2,518,955 teach kits that feature knockdown chairs with arms in which tab-and-slot construction is used to assemble the chairs. U.S. Pat. No. 4,509,794 uses both hooked tabs and non-hooked positioning tabs. However, the latter are not flush-mount.

U.S. Pat. Nos. 2,632,498, and 2,486,987 teach kits similar to those above, only the chairs do not have arms.

The rest of the patents are representative of what is in the art.

None of these references describe a chair with true horizontal arm rests. By this is meant arm rests wherein the plane of the planar stock comprising the arm rest is disposed horizontally, as opposed to prior art arm rests wherein the plane of the stock is disposed vertically and the only horizontal area with which one may support one's arms is the narrow edge created by the thickness of the stock.

All of the patented designs treat the planar parts as rigid masses only capable of either sliding or rotating into position. The present design addresses and relies upon the flexibility of the material. It cannot be assembled or locked if made from rigid stock. Twenty-one snap lock elements (sixteen in the arms, two in the front, and three in the seat) of the total of seventy-four joining elements in the chair, depend on the flexibility of the material in order to function. Further, none of the above prior art designs make use of planar flexing when fully assembled to achieve their joining or locking.

SUMMARY OF THE INVENTION

The present invention is, first of all, a knockdown chair kit which may be assembled by the end user without glue, nails, rivets or other fasteners, and which is strong and durable enough to support an adult human in regular use. The chair is made out of plywood, solid wood, wood composite, plastic, metal or other similar thin, flat stock. It uses a series of notched flanges, hereinafter referred to as "hooks" (or hook means), which hooks of certain members fit into slots (first slot means) having matched positions in other members, in order to rigidly interlock the component members together and prevent them from pulling apart.

Another series of flanges or tabs are flush-mount, i.e. their height equals the thickness of the planar stock, so as not to project outwardly therefrom. The flush-mount flanges or tabs, hereinafter referred to as "pegs" (peg means), tightly fit in matched rectangular apertures ("slots" or second slot means) and prevent members from moving side-to-side or back-and-forth with respect to each other, but do not prevent them from pulling apart. The flush-mount pegs are chiefly used in areas where projecting hooks would interfere with the user's comfort.

One significant feature of the knockdown furniture kit is the use of a pair of hooks to grasp matched slots in the two ends of a U-shaped horizontal arm rest. The arm rest is the last piece to be added to the chair. It is difficult to design a chair which anchors an arm rest horizontally so as to present a flat surface for the user's arm to rest upon. The arm rest hooks of the present invention accomplish this, and, at the same time, the arm rest itself remains permanently flexed in the fully-assembled position, which flexing locks all previously assembled pieces together into one rigid whole.

The kit is fabricated from flat stock by means of laser cutting. Laser cutting results in the precise tolerances which are needed to allow the kit to be assembled into a tight and rigid structure. Other forms of cutting (for example, by saw) have not been able to produce a useable piece of knockdown furniture in the past—at least not without making the piece so expensive as to be impractical. While it is known to use lasers to cut flat panels and other stock, it is believed novel to use laser cutting to produce flat members for use in knockdown furniture.

FEATURES AND ADVANTAGES

An object of this invention is to provide a knockdown chair formed from a plurality of interlocking planar members which includes hook means on some of said members insertably lockable within corresponding first slot means on other of said members, said members being flexible. One of said members is an arm rest member having upper and lower surfaces which are generally horizontally disposed parallel to a plane of said arm member, and having an edge lying vertically perpendicular to said plane, the surfaces being broader than the edge is high.

A feature of this chair is that said arm rest is flexed during assembly into a stressed curved position which locks said members together.

Another feature is flush-mount peg means on some of said members insertably lockable within corresponding second slot means on other of said members.

Still another feature is that at least one of said members (preferably, a plurality), having a first portion of said first slot means, must be flexed before a second portion of said hook means, on at least a second of said members, may be inserted and locked within said first portion.

Another feature is that said members are cut from planar stock by a laser.

Another object is to disclose a knockdown chair which includes two planar side members; two planar arm truss members; a planar face member; a planar tail member; a planar seat member; a planar back member; and a U-shaped planar arm member. Said arm member is bifurcated into two parallel arms and has broad planar upper and lower surfaces disposed parallel to a plane of said arm member, said upper and lower surfaces being separated by a narrow edge lying perpendicular to said plane. The chair also includes hook means on some of said members insertably lockable within corresponding first slot means on other of said members. It further includes flush-mount peg means on some of said members insertably lockable within corresponding second slot means on other of said members, wherein when said hook means is inserted into said first slot means and said peg means is inserted into said second slot means, said plane of said arm member is generally horizontally disposed.

A feature of this chair is that when said hook means is inserted into said first slot means and said peg means is inserted into said second slot means, said two side members, said two arm truss members, said face member, said tail member and said planar back member are all generally vertically disposed and said seat member is generally horizontally disposed.

Another feature is an arm truss notch in a tip of each said arm and an arm rest hook in each arm truss, wherein when said arm rest hooks are inserted into said arm truss notches, said arms are locked into stressed curved flexed positions which lock said members together.

Another feature is a curved upper edge of each truss, against which curved upper edges said arms are firmly pressed when locked into said stressed curved flexed positions.

Preferably, at least two of said members must be flexed before they may be interlocked with other of said members.

Still another object is to disclose a method of making a knockdown chair including the steps of: providing a plurality of planar members; providing hook means on some of said members insertably lockable within corresponding first slot means on other of said members; assembling said chair by flexing at least one of said members having a first portion of said first slot means into a temporarily curved position while inserting a second portion of said hook means on at least a second of said members into said first portion of said slot means; releasing said at least one member from said curved position, whereby said second portion of hook means becomes locked into said first portion of said first slot means; and inserting a third remaining portion of said hook means into a fourth remaining portion of said first slot means, whereby said third remaining portion becomes locked into said fourth remaining portion and all members become interlocked together.

Another feature is an apparatus which is easy to use, attractive in appearance and suitable for mass production at relatively low cost.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

Certain terminology and derivations thereof may be used in the following description for convenience in reference only and will not be limiting. For example, such words as "upwardly," "downwardly," "leftwardly," and "rightwardly" will refer to directions in the drawings to which reference is made unless otherwise stated. Similarly, such words as "inwardly" and "outwardly" will refer to directions toward and away from, respectively, the geometric center of a device and designated parts thereof.

DESCRIPTION OF A PREFERRED EMBODIMENT

Figure 1:
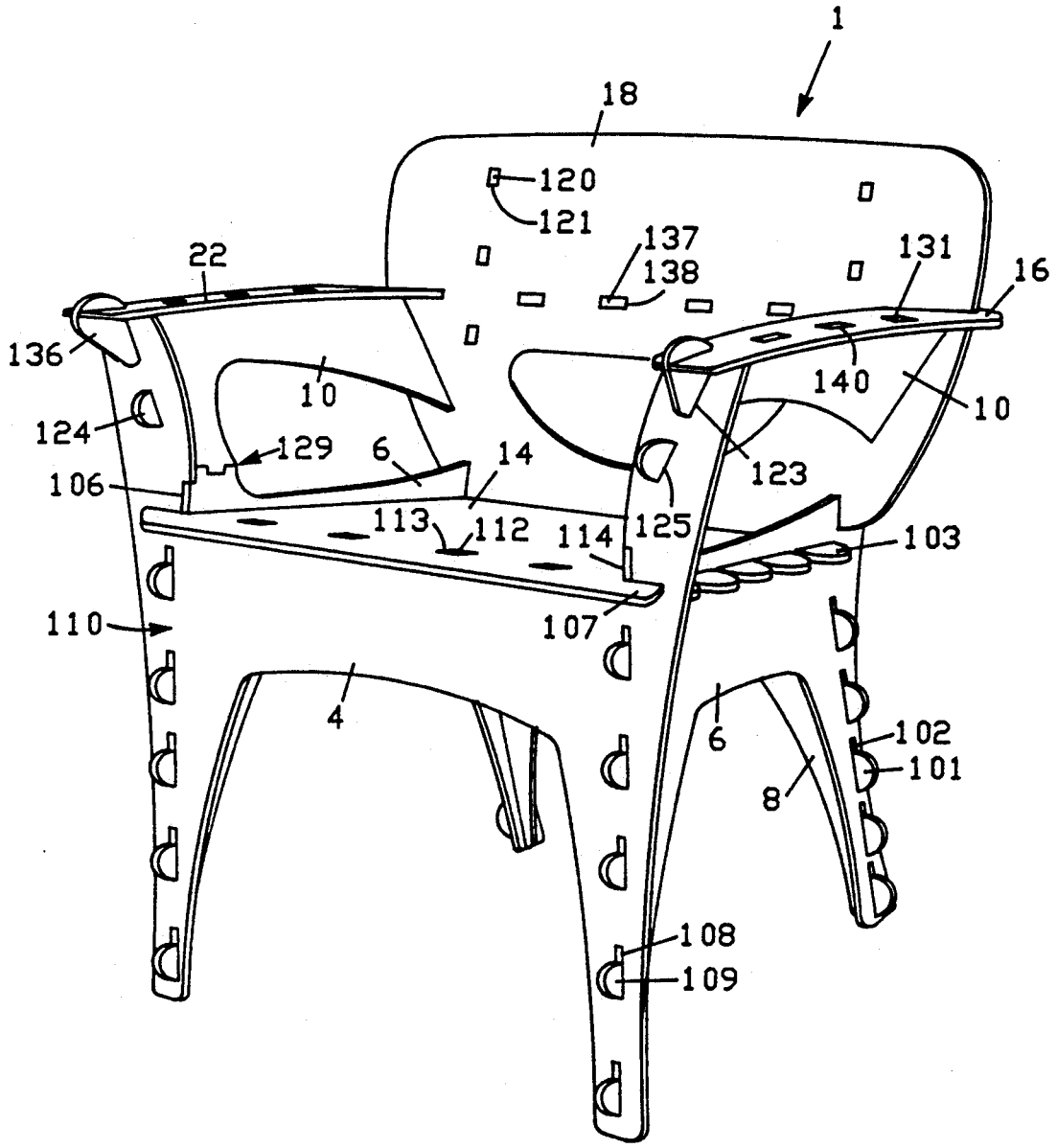
FIG. 1 is is a perspective view of a chair of this invention.

Referring to FIG. 1, there is illustrated therein a knockdown chair 1 of this invention, in its fully-assembled configuration. The chair 1 readily may be assembled into the configuration of FIG. 1 from the disassembled or knocked-down configuration of FIGS. 3–9. This may be done at home by a hobbyist with minimum effort and using no tools, glue, fasteners or paint.

Figure 9:
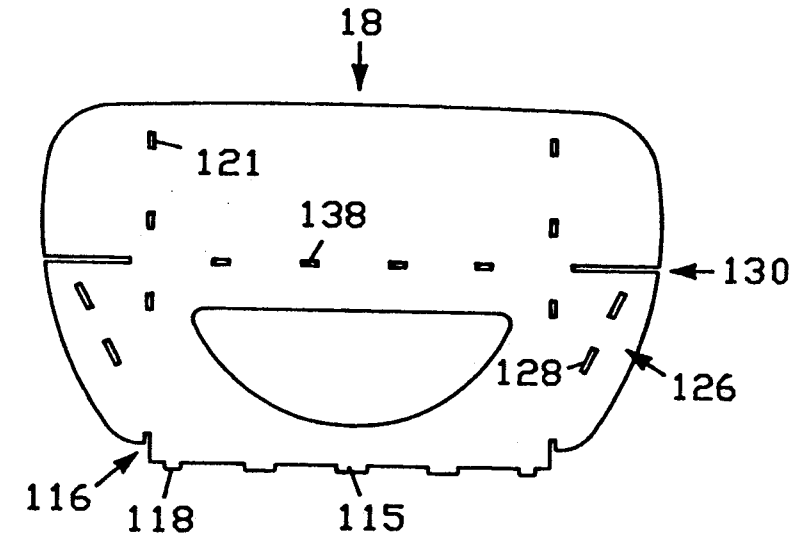
FIG. 9 is a plan view of the back of the chair.
Figure 8:
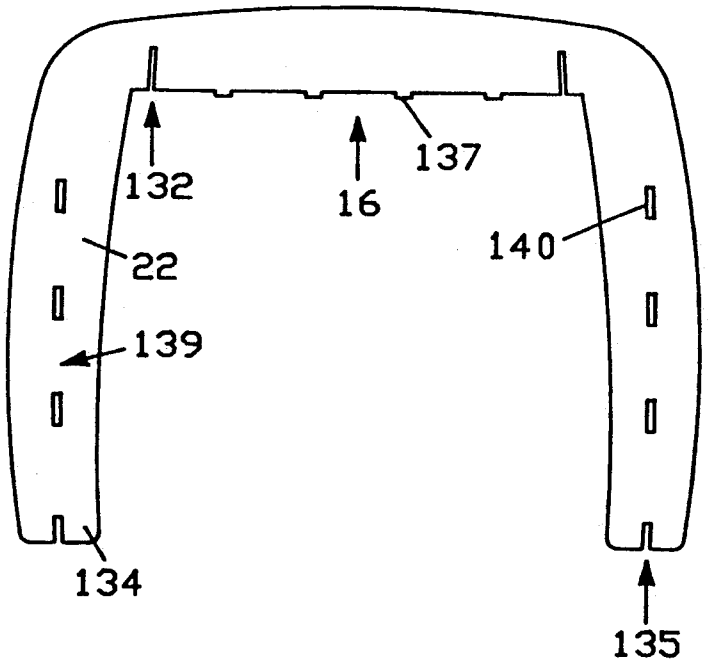
FIG. 8 is a plan view of the arm rest of the chair.

The chair is formed from nine members or pieces of pre-cut stock, namely: the face 4 (FIG. 3); the two sides 6 (FIG. 4); the tail 8 (FIG. 5); two arm trusses 10 (FIG. 6); the seat 14 (FIG. 7); the arm rest 16 (FIG. 8); and the back 18 (FIG. 9). The chair 1 will be shipped and sold un-assembled, preferably in a carton in which these nine members are compactly stacked one on top of the other. Thus, it can be shipped and displayed in a very small area, which is of significant concern to merchants. After assembly, it can be disassembled and reassembled over and over. It can be stored in its disassembled state in a minimum amount of space, which is of significant concern to many consumers, such as apartment dwellers.

The members each may be said to comprise broad upper and lower surfaces disposed parallel to a reference plane (the plane of the member). The upper and lower surfaces are bounded and separated by a narrow edge lying perpendicular to the plane, which edge typically is less than ½ inch high.

The stock from which all of the planar members are formed preferably is thin plywood. However, cardboard, plastic, metal or the like might be useful in some applications. Thin plywood is especially amenable to precision laser cutting. This method of forming the pieces is quick and inexpensive. More significantly, laser cutting is particularly accurate, and the achievement of precise tolerances is important in making a chair that is steady and durable. However, stamping, casting, molding or other alternate methods might be employed in alternate embodiments of the invention.

The relationship between the parts of the chair 1 is best explained by describing the preferred method of assembling the chair from its nine individual planar members.

Assembled correctly, all of the members of the chair 1 will insert, slide, and pop into place without undue forcing. During assembly, some flexing is required, but this will not damage the relatively flexible members. For each of the symmetrical parts, a preferred side may be selected (on the basis of appearance) to face outward. Frequently, the wood grain is more attractive on one side than on the other.

One begins by inserting the side hooks 101 of the tail 8 into the tail slots 102 of the sides 6. Lock the tail 8 and sides 6 by sliding the tail downward.

Gently spread and flex the sides 6 outward at the front of the chair 1, and insert the side hooks 103 of the seat 14 into the seat slots 104 of the sides 6. Start with the rear side hook. Insert one edge of the seat into its side 6, then the other. Do not lock the side hooks 103 by sliding the seat 14 rearward yet, but fully insert them into each side 6. The seat's rear edge will be positioned in front of the seat pegs 105 of the tail 8 and the plane of the seat will be generally horizontally disposed, sloping gently upward from back to front.

Position the face 4 onto the front of the seat 14, hanging first one, then the other, seat-and-side notch 106 of the face behind the face flanges 107 of the seat. Align and insert the side slots 108 of the face 4 over the face hooks 109 of the sides 6

Flex the face 4, pressing rearward at the solid areas 110 formed between the top two side slots 108, and slide the face upward just enough to hook it in this flexed position. Do one side, then the other.

Flex the rear edge 15 of the seat 14 up and over the seat pegs 105 of the tail 8, sliding the seat rearward, placing the pegs 105 in the double-wide back-and-tail slots 111 of the seat, locking the sides 6 to the seat 14. Align and engage the seat pegs 112 of the face 4 with the face slots 113 of the seat 14.

Slide the sides 6 fully downward, locking the face hooks 109 of the sides into the side slots 108 of the face 4, inserting the seat pegs 112 of the face into the face slots 113 of the seat 14, and letting the face peg 114 of each side 6 pop into its seat-and-side notch 106 of the face. This relieves the flexing of the face 4, and locks the face to the sides.

Align and insert the center three main seat pegs 115 of the back 18 into the double-wide back-and-tail slots 111 of the seat 14, in front of the seat pegs 105 of the tail 8, which pegs 105 also occupy the back-and-tail slots. Engage the side notches 116 of the back 18 with the back notches 117 of the sides 6 and insert the back further into engagement with the seat and sides. Align the two outer seat pegs 118 of the back 18 with their back slots 119 of the seat 14, and fully insert the back into the seat, closing the gap. Insert the back pegs 120 of the sides 6 into the side slots 121 of the back 18.

Engage each arm truss 10 with the face 4 by hooking the face notch 122 of the arm truss into the arm truss notch 123 of the face. With a downward arcing motion, insert the face tab 124 of each arm truss 10 into its arm truss slot 125 of the face 4.

Flex the back 18 rearward at area 126 to insert the back pegs 127 of each arm truss 10 into the arm truss slots 128 of the back, without marring the back. Check that the joint 129 between the sides 6 and the arm trusses 10 are correctly positioned, i.e. that the side peg **129*a* of each arm truss fits smoothly within its arm truss notch 129*b*** of its associated side.

Figure 2:
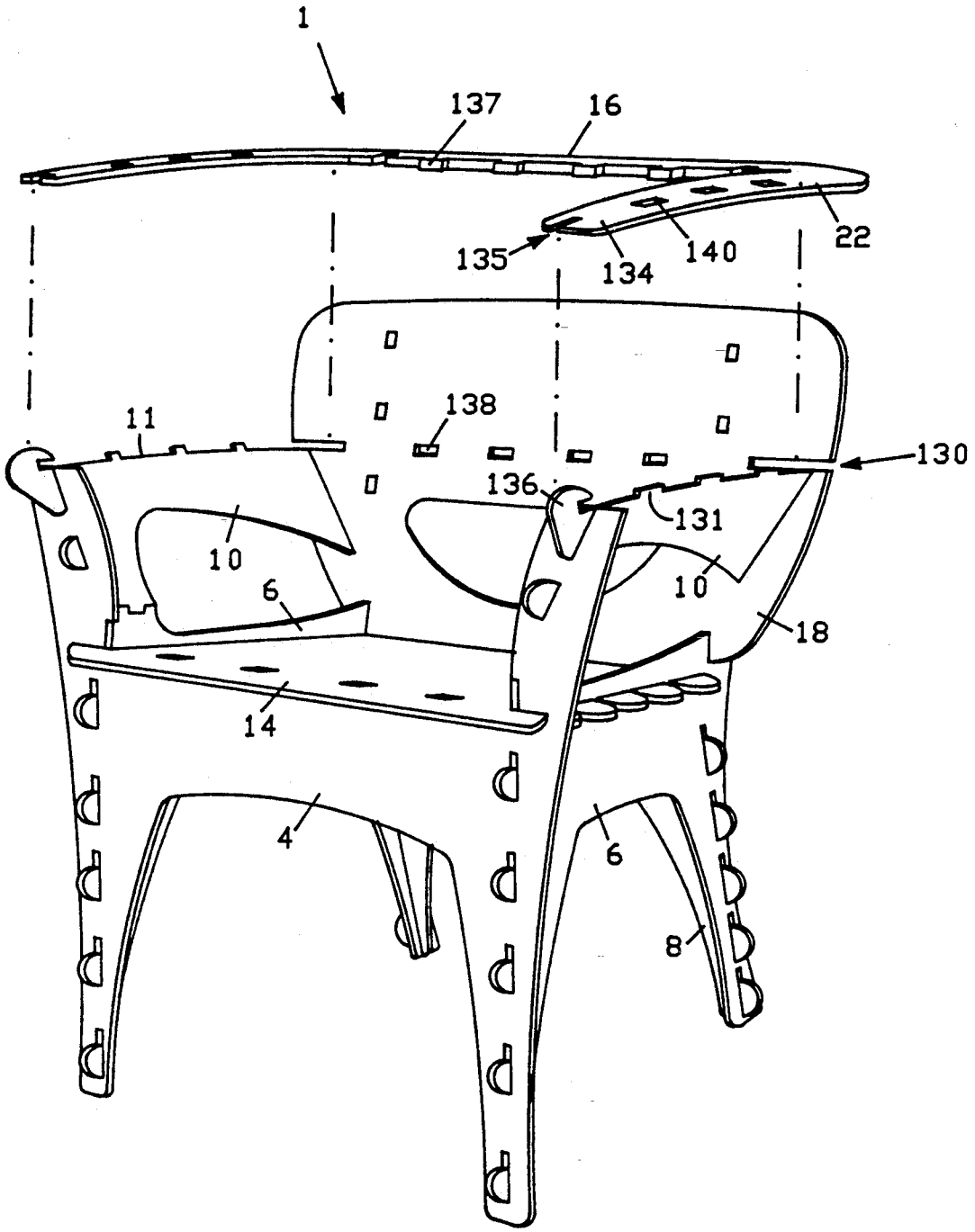
FIG. 2 is a perspective view of the same chair in a partially exploded position.
Figure 4:
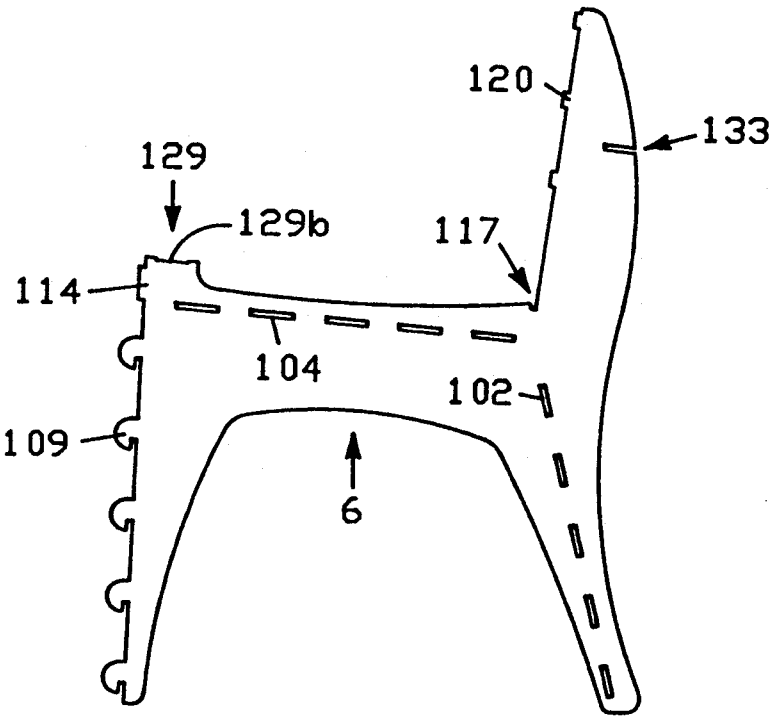
FIG. 4 is a plan view of the right side of the chair, the left side being identical thereto.
Figure 3:
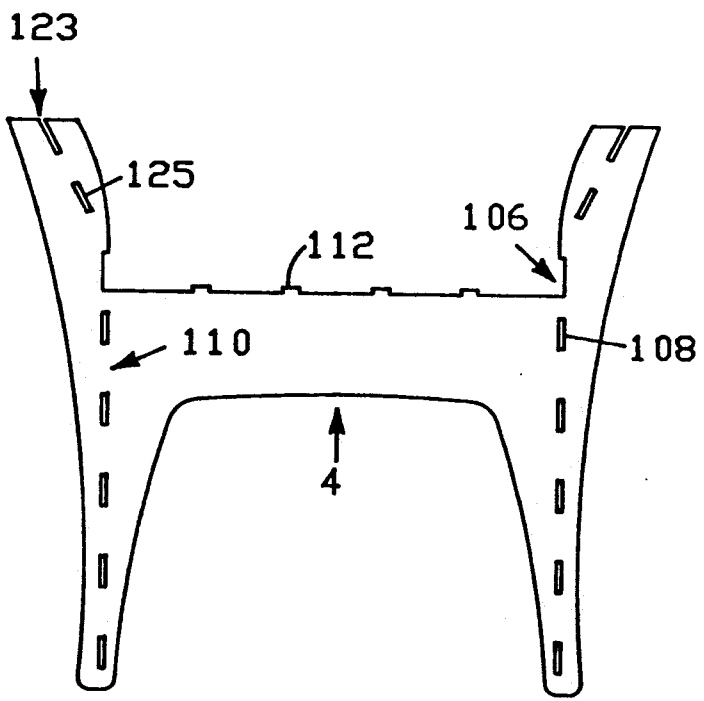
FIG. 3 is a plan view of the face of the chair.
Figure 7:
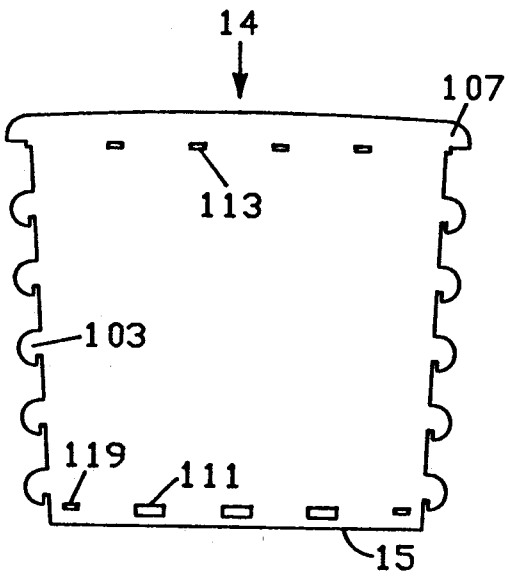
FIG. 7 is a plan view of the seat of the chair.
Figure 5:
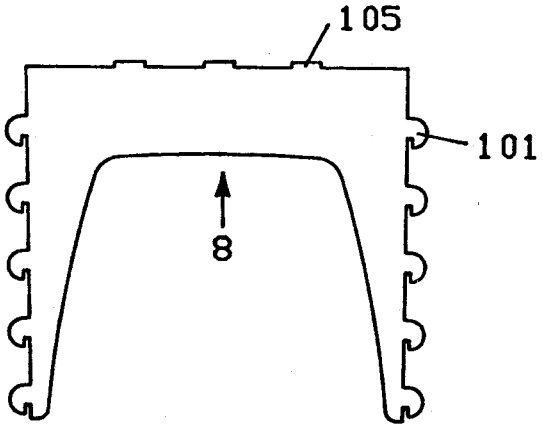
FIG. 5 is a plan view of the tail of the chair.
Figure 6:
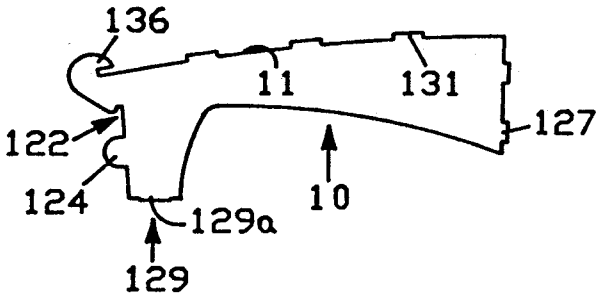
FIG. 6 is a plan view of the right arm truss of the chair, the left arm truss being identical thereto.

FIG. 2 shows the chair 1 just prior to the attachment of the arm rest 16, which is the last step of assembly.

Slide both arms 22 of the arm rest 16 forward through the arm rest notches 130 of the back 18, and over the arm pegs 131 of the arm trusses 10. Slide both arms 22 forward together, parallel with the sides 6. Slide them forward enough to align and engage the side notches 132 of the arm rest 16 with the arm rest notches 133 of the sides 6. Flex the sides 6 horizontally and the arm rest 16 vertically to align these notch pairs. When these notches are engaged, flex the tip 134 of each arm 22 downward and slide it forward, engaging its arm truss notch 135 with the arm rest hook 136 of its arm truss 10. Slide the arm rest 16 forward just enough to hook it in this downward position.

Insert the back pegs 137 of the arm rest 16 into the arm rest slots 138 of the back 18 by vertically flexing the back pegs 137 and sliding the arm rest fully forward into the arm rest notches 133 of the sides 6. Flex the arm rest arms 22 upward at area 139 to free the arm pegs 131 of the arm trusses 10, and position the arm pegs inside their arm truss slots 140 of the arms 22. Press the arms 22 downward to firmly seat the arm pegs 131 in the arm truss slots 140. The arms remain permanently flexed, under stress, into an arcuate shape, being pressed firmly against the gentle arc of the curved upper edge 11 of each truss 10 and being molded thereby. Their tendency to return to a planar shape helps lock the chair into a stable rigid configuration. The chair 1 is now fully assembled, as shown in FIG. 1.

The chair 1 is attractive, rigid and stable; yet it is remarkably comfortable to use. Pegs 105, 112, 114, 120, 127, 131 and 137 are all flush-mount so as not to detract from this comfort.

While the above provides a full and complete disclosure of the preferred embodiments of this invention, various modifications, alternate constructions, and equivalents may be employed without departing from the true spirit and scope of the invention. Such changes might involve alternate materials, components, structural arrangements, sizes, operational features or the like. Therefore, the above description and illustrations should not be construed as limiting the scope of the invention which is defined by the appended claims.

What is claimed is:

1. Knockdown chair apparatus including:

two planar side members;

two planar arm truss members;

a planar face member;

a planar tail member;

a planar seat member;

a planar back member;

a U-shaped planar arm member, said arm member being bifurcated into two parallel arms and having broad planar upper and lower surfaces disposed parallel to a reference plane of said arm member, said upper and lower surfaces being separated by a narrow edge lying perpendicular to said reference plane;

hook means on some of said members insertably lockable within corresponding first slot means on other of said members;

flush-mount peg means on some of said members insertably lockable within corresponding second slot means on other of said members, wherein when said hook means is inserted into said first slot means and said peg means is inserted into said second slot means, said reference plane of said arm member is generally horizontally disposed.

2. The apparatus of claim 1 wherein:

when said hook means is inserted into said first slot means and said peg means is inserted into said second slot means, said two side members, said two arm truss members, said face member, said tail member and said planar back member are all generally vertically disposed and said seat member is generally horizontally disposed.

3. The apparatus of claim 1 wherein:

when said hook means is inserted into said first slot means and said peg means is inserted into said second slot means, said arms are flexed into stressed curved positions which lock said members together.

4. The apparatus of claim 3 further including:

an arm truss notch in a tip of each said arm; and an arm rest hook in each arm truss, wherein when said arm rest hooks are inserted into said arm truss notches, said arms are locked into said stressed curved flexed positions.

5. The apparatus of claim 4 further including:

a curved upper edge of each truss, against which curved upper edges said arms are firmly pressed when locked into said stressed curved flexed positions.

6. The apparatus of claim 5 wherein:

at least two of said members must be flexed before they may be interlocked with other of said members.

* * * * *